United States Patent [19]

McFarland, Jr.

[11] 3,931,811

[45] Jan. 13, 1976

[54] INDEPENDENT RUNNER INTAKE MANIFOLD FOR A V-8 INTERNAL COMBUSTION ENGINE HAVING EACH RUNNER IN A DIRECT PATH WITH A THROAT OF A FOUR-THROAT CARBURETOR

[75] Inventor: James D. McFarland, Jr., Chatsworth, Calif.

[73] Assignee: Edelbrock Equipment Co., El Segundo, Calif.

[22] Filed: Dec. 23, 1974

[21] Appl. No.: 535,284

Related U.S. Application Data

[60] Continuation-in-part of Ser. No. 130,329, April 2, 1971, Pat. No. 3,744,463, which is a division of Ser. No. 280,295, Aug. 14, 1972, abandoned.

[52] U.S. Cl. ..... 123/52 M; 123/52 MV

[51] Int. Cl.[2] ..... F02B 75/18

[58] Field of Search ..... 123/52 M, 52 MV

[56] References Cited

UNITED STATES PATENTS

| | | | |
|---|---|---|---|
| 974,992 | 11/1910 | Rice | 123/52 M |
| 2,733,695 | 2/1956 | Goodridge | 123/52 MV |
| 2,759,462 | 8/1956 | Haltenberger | 123/52 MV |
| 2,882,875 | 4/1959 | Kolbe | 123/52 MV |
| 3,014,470 | 12/1961 | Burrell | 123/52 MV |

FOREIGN PATENTS OR APPLICATIONS

| | | | |
|---|---|---|---|
| 685,492 | 4/1930 | France | 123/52 M |

*Primary Examiner*—Charles J. Myhre
*Assistant Examiner*—Daniel J. O'Connor
*Attorney, Agent, or Firm*—Christie, Parker & Hale

[57] ABSTRACT

The plenum of an independent runner manifold is oriented at an angle to the longitudinal center line of the manifold such that each carburetor throat of a four barrel carburetor sees the entire entrance of two adjacent runners of different runner pairs. Each of four runner pairs has two runners leading from the plenum to side-by-side inlet ports. The wall lengths within a runner are made at least nearly equal to each other. A sudden enlargement, in the form of a step, is provided proximate the entrance of each runner of a manifold to the ports of an engine along the outer wall thereof where mixture velocity is relatively low with respect to mixture velocity elsewhere in the same velocity profile. The enlargements control reverse mixture flow and increase the amount of mixture entering the engine's cylinders. It is believed that this increase in flow is partially due to a reduction or elimination of boundary layer separation in the inlet port. The geometry of the runners is such as to promote relatively high mixture velocity. Specifically, the cross-sectional area of each runner progressively diminishes downstream from the entrance to the runner at the manifold's plenum.

14 Claims, 11 Drawing Figures

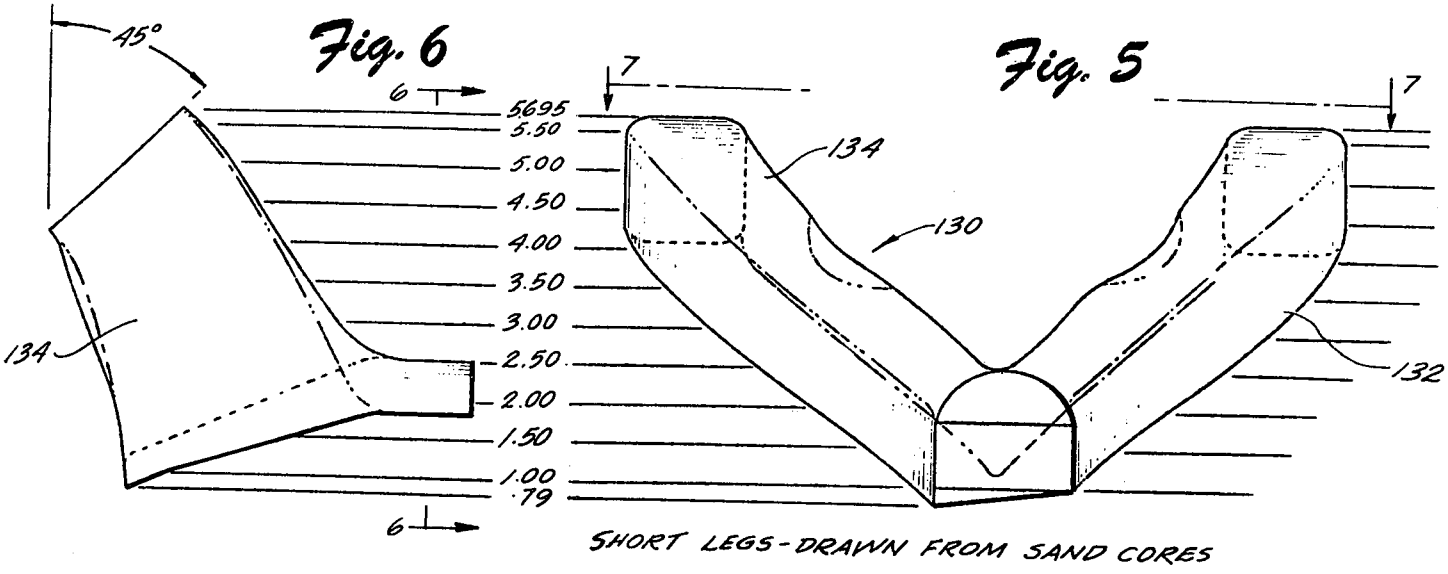
Fig. 5
Fig. 6
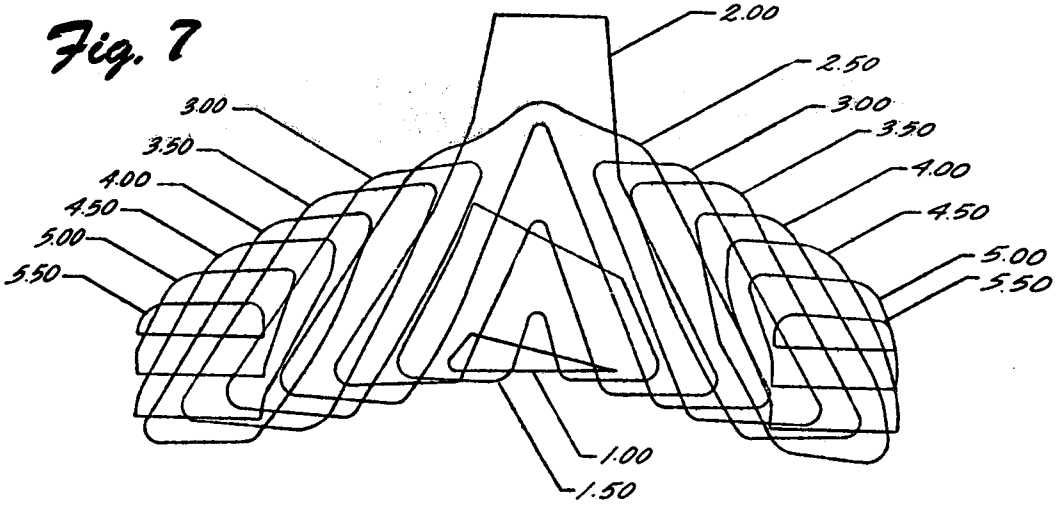
Fig. 7
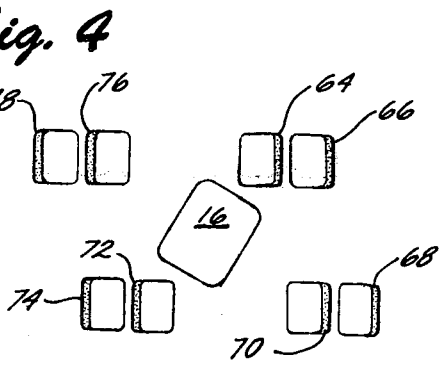
Fig. 4

11
10
140
136
138
45°
6.392
6.00
5.50
5.00
4.50
4.00
3.50
3.00
2.50
2.00
1.50
1.00
38
40
76
78
79

INDEPENDENT RUNNER INTAKE MANIFOLD FOR A V-8 INTERNAL COMBUSTION ENGINE HAVING EACH RUNNER IN A DIRECT PATH WITH A THROAT OF A FOUR-THROAT CARBURETOR

CROSS REFERENCE TO RELATED APPLICATIONS

This is a continuation-in-part application of U.S. patent application Ser. No. 130,329 now U.S. Pat. No. 3,744,463, filed Apr. 2, 1971 and which is a division of application Ser. No. 280,295, now abandoned, filed Aug. 14, 1972.

BACKGROUND OF THE INVENTION

The present invention relates in general to intake manifolds for internal combustion engines. More in particular, the present invention relates to intake manifolds of the high performance type.

A carburetor internal combustion engine employs an inlet manifold to distribute a fuel-air mixture produced by the carburetor into the cylinders of the engine. The mixture is drawn into the combustion chambers of the engine by a vacuum created there by piston movement during the "suction stroke" of each cylinder. The amount of work done by the engine to produce the vacuum and draw the fuel-air mixture into the combustion chambers forms a part of the engine's "pumping-friction" work.

In a V-8 engine there are typically eight inlet ports for the passage of the fuel-air mixture into the eight combustion chambers of the engine. An inlet manifold for a V-8 engine communicates the carburetor with the engine's inlet ports through "runners". A runner is a duct or passageway. When two of these "ducts" are side-by-side the combination of the two is often called "a runner" with each duct called "a leg." Usage also permits that each of the side-by-side ducts be called a runner and this meaning will be employed throughout this specification. In any event, individual runners between each of an engine's inlet ports and a plenum of the manifold located immediately below the carburetor are known.

The induction of fuel-air mixtures into an internal combustion engine is an extremely complicated phenomenon and has given rise to several conflicting problems.

One of the most important problems is pumping-friction work. As previously mentioned, a fuel-air mixture is inducted into an internal combustion engine through the manifold. The engine acts as a pump when it produces the vacuum responsible for the pressure drop through the manifold between atmosphere and the combustion chambers, which pressure drop constitutes the driving force acting on the fuel-air mixture. Obviously this pumping requires power. Power lost to flow losses of the mixture through the manifold reduces the engine's output and its efficiency. As a consequence of this, one aspect of good manifold design is to provide minimum losses because of flow phenomena.

Another problem in manifold design is the effect of the pressure history of individual cylinders on other cylinders. Pressure pulses, both positive and negative with respect to atmosphere, travel up and down the runners of a manifold and are generated from such constantly recurring events as inlet valve openings. While a pressure pulse phenomenon can sometimes be used to advantage in augmenting the driving force acting on the mixture during its induction into the cylinders, the phenomenon can actually reduce the driving force unless the phase relationship of the pressure pulses is just right. Pressure pulses can also lead to a problem known in this art as "standoff." Standoff is a condition where fuel-air mixture is forced back through a manifold and carburetor to atmosphere because of a pressure condition existing in the manifold. Standoff occurs at well-defined engine speeds for a particular engine-manifold-carburetor combination. Standoff manifests itself as a cloud of gasoline vapor and droplets over the carburetor.

Another problem in good manifold design is to provide a uniform fuel-to-air mixture in each of the cylinders it supplies. Carbureted fuel is a mixture of vaporized fuel, atomized fuel and liquid fuel. Liquid fuel travels along the walls of a runner towards an inlet port under the influence of the gaseous mixture passing through the runner above it and gravity. In practice, this liquid component of the fuel charge has made it extremely difficult to keep fuel-to-air ratios uniform to each of the cylinders of an engine. Atomized fuel is not truly a vapor but is instead very fine particles of liquid. Atomized fuel is carried in suspension by the air stream between the carburetor and the cylinders. Because the particles of atomized fuel are heavier than their carrying air stream there is a tendency for them to come out of suspension when the fuel-air mixture turns a corner. This is because the vapor has a tendency to go straight while the gas wants to turn the corner. When the atomized fuel comes out of suspension, the problem of keeping the fuel-air ratio the same for all cylinders is, of course, aggravated.

In an effort to maintain atomized fuel in suspension in the mixture stream, it has been the practice to increase the kinetic energy of the atomized fuel by increasing the velocity of the mixture through the runners. The velocity of the mixture is increased by reducing the cross-sectional area of the runners. But the approach of increasing atomized fuel kinetic energy obviously runs into problems when corners or bends in the runners are required, for the fuel particles will strike the outside wall of the bend and come out of suspension.

One of the most popular manifolds produced in this country is the so-called two-plane, over and under, 180° manifold. This manifold has been a standard for most American production V-8 engines for use with a single, standard four-barrel carburetor for some time. The manifold has runners disposed in a relatively complex pattern. The design of the manifold attempts to minimize the problems of efficient fuel distribution, the adverse effects of pressure interference of one cylinder on another cylinder, and standoff. But the two-plane, 180° manifold is a compromise. It uses a twisting, tortuous path in each of the runners which results in excellent control of inter-cylinder interference and standoff but produces poor air-to-fuel ratio uniformity between cylinders and high "pumping-friction" work because of high flow losses. Another problem with the tortuous paths of the runners in the two-plane manifold is that inter-cylinder fuel-to-air ratios vary over a wide range resulting in a compromise in carbureting an engine which produces less than optimum emissions and performance.

SUMMARY OF THE INVENTION

The present invention provides a manifold which improves the quantity of fuel and air delivered to an internal combustion engine for a given amount of engine pumping. Stated in other words, the manifold of the present invention is capable of passing fuel-air mixture from a carburetor to an engine in a highly efficient manner and therefore reduces engine pumping-friction work. It has also been observed that the manifold results in good emission performance for the oxides of nitrogen, carbon monoxide, and unburned hydrocarbons.

The present invention provides an independent runner manifold having a single plenum for a standard four-barrel carburetor. Preferably there are eight runners comprised of four pairs of side-by-side runners. Each runner communicates the plenum and carburetor with a single inlet port of a V-8 internal combustion engine. The plenum is oriented to an angle to the longitudinal centerline of the manifold to present to each of the four throats of the carburetor two of the runners from different pairs of runners. More explicitly, the plenum chamber has a generally rectangular entrance oriented at an acute angle to a bisecting plane through the longitudinal centerline of the manifold and with the sides of the entrance at an acute angle to the bisecting plane so that adjacent non-paired runners share an unobstructed single throat of a four-barrel carburetor mounted on the plenum body in register with the plenum entrance.

Each runner is rectangular in cross section and the four walls thereof are made as nearly equal in length to each other as practical. To make intra runner wall lengths sensibly equal, the outer of each pair of runners has an inner wall which effectively begins further down the runner than the wall of the inner runner of the pair, the two runners sharing the same wall after the beginning of the inner wall of the outer runner.

The entrance of each runner is laid over slightly such that fuel and air lean into the curve of the runner in the manner of a bicyclist going around a corner. Stated in different words, the roof of each runner is further from the bisecting plane than the floor along the laid over portion.

The manifold of the present invention is adapted to have its runners along a line-of-sight path to the inlet ports from the plenum to reduce flow losses and the opportunity for fuel to come out of suspension. One consequence of this is that inter-cylinder fuel-to-air ratios are confined to a narrow range.

With each runner seeing a full carburetor throat, the runners are not obstructed by the walls of other runners and therefore the mixture paths from the throats through the runners are not obstructed. By making wall lengths within each runner sensibly equal, more uniform and less free flow of the fuel-air mixture results.

Preferably, the present invention provides a sudden enlargement in the flow path of each runner-inlet port combination. The enlargement is generally in the vicinity of the junction between an inlet port and a runner in the area of the flow path where mixture velocity is low in comparison to the velocity elsewhere in the same velocity profile. Typically, in a runner which provides "line-of-sight" communication between an inlet port and the entrance to a runner from a manifold plenum, mixture velocity in a velocity profile will be highest in the vicinity of the line-of-sight.

In the manifold specifically described in this specification, the step of each runner is located at the interface between each runner and a cooperating inlet port of an engine along the outer wall of the runner.

Normally the sudden enlargement is in the form of a step between a manifold runner and an associated inlet port at the junction between the two, and with the step facing the inlet port. However, the step need not be at the interface between a port and a runner, depending on manifold and engine type, but should be in the general vicinity of the inlet port. It is believed that the step improves manifold efficiency by reducing or eliminating standoff problems through some sort of capture of reverse flowing fuel and air mixture and, possibly, by reducing or eliminating boundary layer separation in the inlet port just upstream from the inlet valve. It is also believed that the step forms a barrier or dampener against pressure pulses traveling from the inlet port to the manifold's plenum to reduce the problem of inter-cylinder pressure interference.

More specifically, it is believed that the step which, again, faces its inlet port, provides a positive barrier or dampener to prevent pressure waves from traveling upstream in a runner to carry with them fuel and air, and to prevent or attenuate inter-cylinder interference because of these waves. It is not known if the step actually absorbs pressure energy, but the step seems to isolate the inevitable pressure pulses which occur in the induction system acting in opposition to desired stream flow. Secondly, it is believed that the step could result in the energization of the boundary layer in the inlet port to prevent boundary layer separation. Any prevention of boundary layer separation increases the amount of fuel and air which reaches the cylinders for a given amount of engine pumping.

What is believed to be a significant aspect of the present invention is the ability of providing a continuous reduction in cross-sectional area in each runner as it approaches its inlet port. This reduction in cross-sectional area results in ever-increasing stream velocity as the ports of an engine are approached, and a positive velocity gradient which reduces any tendency for boundary layer separation within the runner. The ability to provide for this diminution in cross-sectional area in each of the runners is believed to result from the provision of the discontinuity or step which ensures against boundary layer separation normally associated with rapidly moving streams flowing around corners.

These and other features, aspects and advantages of the present invention will become more apparent from the following description, appended claims and drawings.

BRIEF DESCRIPTION OF THE FIGURES

FIG. 4 is a schematic illustrating the mismatch between cylinder head ports and the manifold illustrated in the first three Figures, as seen looking down on an engine typified by the so-called 427 big block Chevrolet engine;

FIG. 5 is a top plan view of a sand core for the inner runners on one side of the manifold of FIGS. 1 through 3;

FIG. 6 is a side elevational view of the sand core shown in FIG. 5 taken in the plane 6—6 of FIG. 5;

FIG. 7 is a frontal elevational view of the sand core shown in FIG. 5 taken in the plane 5—5 of FIG. 5;

DESCRIPTION OF THE PREFERRED EMBODIMENTS

Figure 1:
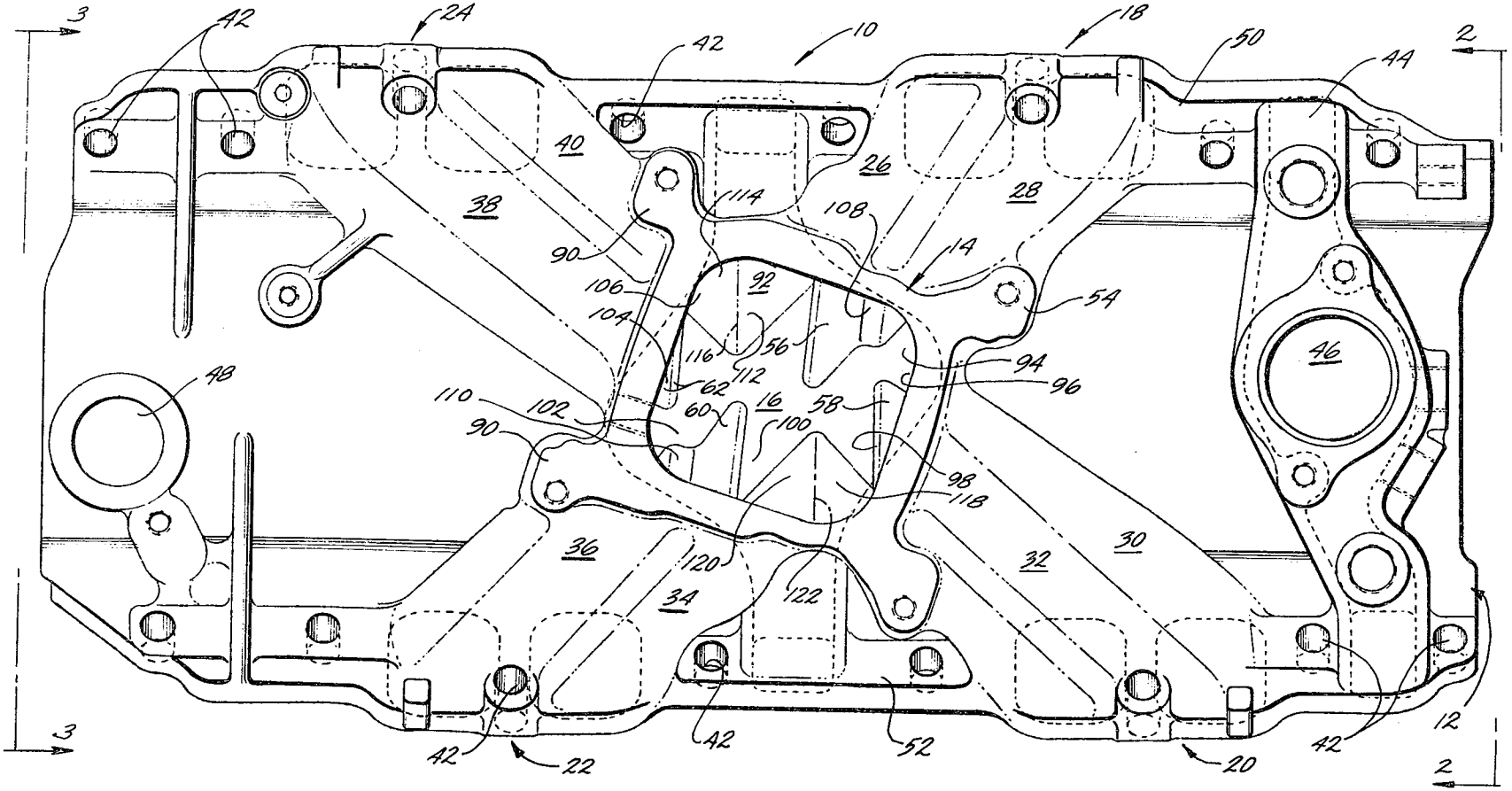
FIG. 1 is a plan view illustrating a preferred embodiment of the manifold of the present invention.
Figure 2:
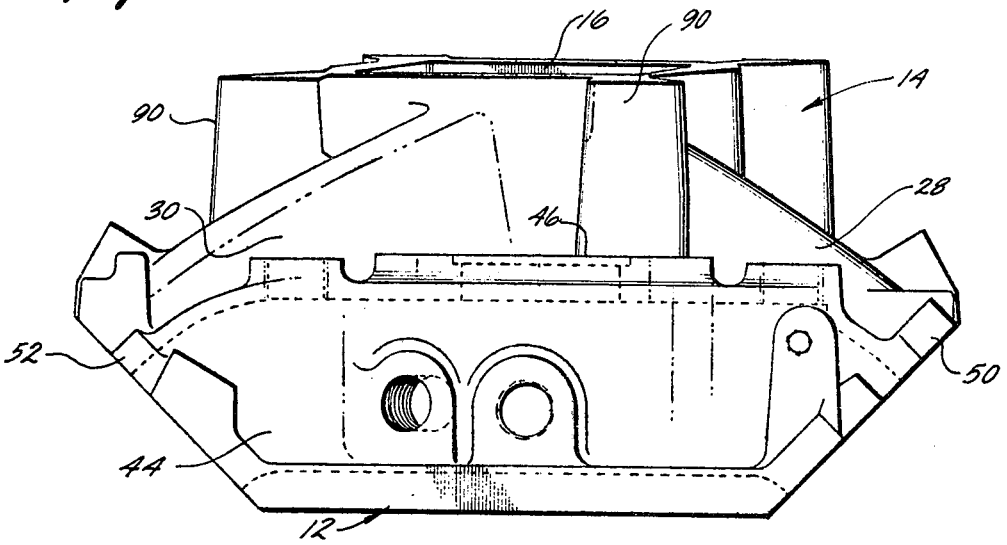
FIG. 2 is a frontal elevational view of the manifold illustrated in FIG. 1.
Figure 3:
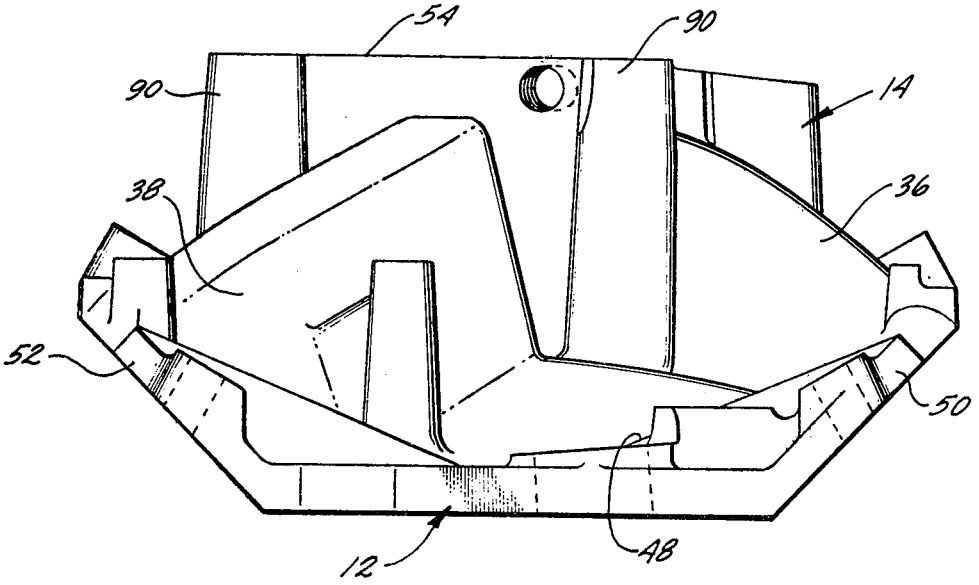
FIG. 3 is a rear elevational view of the manifold illustrated in FIG. 1.

With reference to FIGS. 1 through 3, an improved manifold 10 in accordance with the preferred embodiment of the present invention is illustrated. This manifold is adapted for use with a V-8 engine and a single four-barrel carburetor. In general, the manifold comprises a base 12, a plenum body 14, a plenum 16 defined by the plenum body, and four runner pairs 18, 20, 22 and 24. Each runner pair includes individual runners, sometimes referred to as legs. These individual runners are indicated by even-numbered reference numerals 26 through 40 for runner pairs 18 through 24, respectively. Each of the runners is adapted to communicate with an associated inlet port of an internal combustion engine and direct fuel and air from plenum 16 into the inlet ports.

Base 12 of manifold 10 has a plurality of holes 42 for attaching the manifold to the engine it is used with in a conventional manner, as through bolts. Engine coolant crossover passage 44 is provided to communicate the coolant jackets of the heads of the engine used with the manifold. A neck 46 is to communicate the coolant jackets with a radiator. A distributor mounting hole 48 at the opposite end of base 12 is to receive a distributor. The base along its longitudinal sides, indicated by reference numerals 50 and 52, is angled to conform to the angle in the valley between the banks of cylinders of the engine and for proper seating of the manifold on the heads of the engine.

Plenum body 14 has an upper surface 54 which is adapted for the mounting of a single four-barrel carburetor. As is clearly evident from FIG. 1, plenum 16 is in free and open communication with the entrance to each of the runners.

Each of the runners has a configuration to effect, as closely as possible, line-of-sight communication between plenum 16 and the inlet port of the runner's corresponding inlet port.

As is seen, each of the runner pairs has a partition between them. These partitions are indicated by even-numbered reference numerals 56 through 62 for runner pairs 18 through 24 respectively.

Each runner progressively diminishes in cross section from plenum 16 to its exit into its associated inlet port. This feature provides for a positive velocity gradient which controls boundary layer separation within the runners and also serves to increase the velocity of the fuel-air mixture passing through the runners. It is believed that this increase in velocity in the particular runner configuration illustrated prevents separation of atomized fuel from the air stream and results in more fuel and air reaching the cylinders as charges.

Manifoid 10 is adapted to cooperate with the heads of an internal combustion engine to develop a mismatch between the heads and the manifold at the exits of the runners into the inlet ports of the heads. In other words, there is a mismatch between each runner at its exit and its associated inlet port at the latter's inlet. This mismatch defines a step or sudden enlargement in the flow path of fuel-air mixture passing through the runner and into the inlet port for ultimate passage into the inlet port's cylinder. This step is located in the vicinity of the entrance to the inlet port in an area or zone where the velocity of the fuel-air stream is low relative to the velocity of the stream elsewhere in the same velocity profile. As a general rule this area or zone of low stream activity is away from the most direct, or line-of-sight path between the cylinder and the plenum of a manifold. Another way of finding the zone where the step should be, in general, is along the outer wall of a runner, the wall presenting a concave surface to the fuel and air mixture.

For the particular manifold illustrated in the first three Figures, the mismatch, or steps, which produce the sudden enlargement in the flow stream for each runner is illustrated schematically in FIG. 4, as they would appear looking down on top of an engine. The steps are shown to be on the outside wall of each runner and are indicated by the stipple. Specifically the steps are shown by even-numbered reference numerals 64 through 78 for runners 26 through 40 respectively.

The steps provided by the manifold of the present invention provide a sudden enlargement in a cross-sectional area of each of the runners in the vicinity of its associated inlet port. For the manifold illustrated in FIGS. 1 through 3 this enlargement may be viewed as a calculated mismatch where a runner meets the head or a step in the runner proper. Again for the illustrated manifold, the mismatches or steps are on the outside of the port-manifold interface in the area of each runner where stream velocity is relatively low in comparison with the stream velocity along the opposite inside wall.

Figures 8, 9, 10, 11:
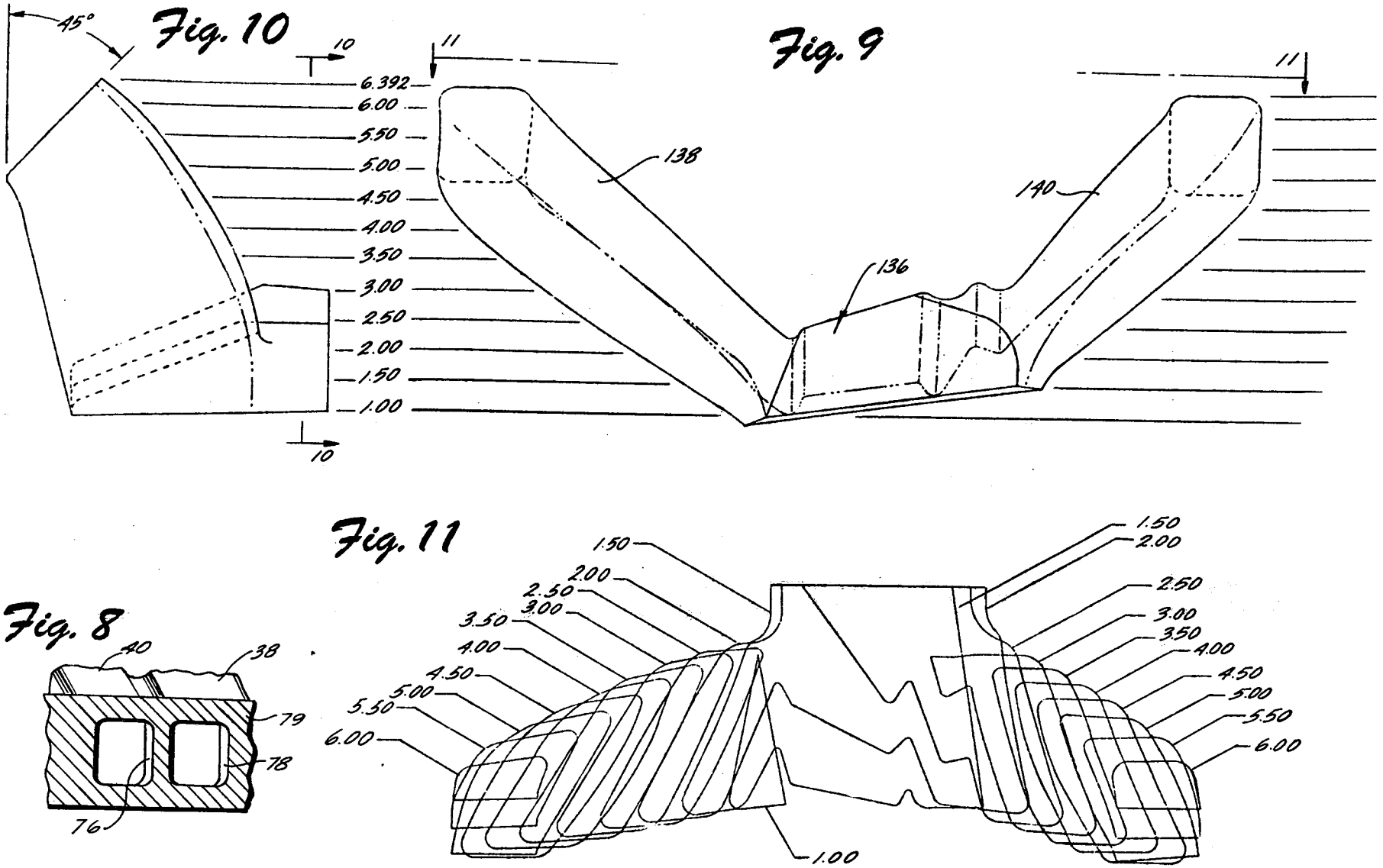
FIG. 8 is a fragmentary view showing the steps which produce the mismatch between the runners and the inlet ports of the illustrated manifold.
FIG. 9 is a top plan view of a sand core for the outer runners of one side of the manifold of FIGS. 1 through 3.
FIG. 10 is a side elevational view of the same core shown in FIG. 9 taken in the plane 10—10 of FIG. 9.
FIG. 11 is a frontal view of the sand core shown in FIG. 9 taken in the plane 11—11 of FIG. 9.

With reference to FIG. 8, the steps are shown for runners 38 and 40 looking towards them from within a pair of inlet ports of an engine in a head 79 thereof.

It is not known with certainty why the provision of a step in this area of relatively low stream activity, in a velocity sense, is effective in manifold design, but it is. It is clear that the step itself could provide for some capture of pressure pulses emanating from within the engine and traveling towards the manifold plenum. It is also possible that the step could cause the energizing of a boundary layer in the inlet port and either prevent or reduce the amount of boundary layer separation there. It is expected that any boundary layer separation in the inlet ports of an engine will result in significant reduction in the amount of fuel and air reaching a cylinder, and a corresponding loss of power. The provision of a step also decreases the cross-sectional area in a runner and as a consequence increases stream velocity. This increase in stream velocity may also account, at least in part, for improved manifold performance.

With reference again to FIG. 1, plenum body 14 is disposed at an angle to the longitudinal centerline of the manifold. The generally rectangular entrance into plenum chamber 16 is also angularly offset from the centerline. More specifically, the plenum chamber is at an acute angle to a bisecting plane through the longitudinal centerline of the manifold and with the sides of the entrance at an acute angle to the bisecting vertical plane. A standard four-barrel carburetor having four throats mounted on mounting base 54 of the plenum body and secured in register with the entrance to the body, as by fasteners in mounting bosses 90, will present each of its four throats to two runners of different runner pairs. Thus, a carburetor throat will be presented to runners 28 and 30, a second carburetor throat will be presented to runners 32 and 34, a third carburetor throat will be presented to runners 36 and 38, and finally a fourth carburetor throat will be presented to runners 40 and 26. The location of the carburetor throats and the entrance to each of the runners are such that the runners see a complete carburetor throat without being obstructed by other structure of the manifold. Stated in different words, each of the runners has an entrance indicated by even-numbered reference numerals 92 through 106 for runners 26 through 40, respectively. The plenum chamber is oriented such that the four throats of a standard four-barrel carburetor will open directly into the entrances of the runners. Thus, for a throat oriented in the upper right-hand quadrant above the plenum body and over the plenum itself will open directly into entrances 94 and 96 of runners 28 and 30.

Within limits, every attempt is made to make the intra-runner wall lengths nearly equal. Each runner has a generally quadrilateral cross section presented to the flow of a mixture of fuel and air. The walls are roof and floor walls, and side walls. The four walls of the runner defining the quadrilateral cross section for fuel and air mixture flow are, then, made as sensibly equal as possible. It has been found in so doing that the fuel-air mixture flow characteristics are more uniform throughout the cross section and throughout the length of the runner, resulting in less flow losses and better fuel retention in the air. In terms of entrances to each of the runners, the equalization of wall lengths presents an entrance cross-sectional area wherein the mixture velocity and pressure profiles are substantially uniform. This means that there will be no areas in the entrance cross section where mixture velocity will be significantly higher than in other areas in the same cross section, and, as a consequence, friction losses are relatively low. This uniformity in entrance velocity and pressure profiles is particularly important in avoiding excessively high velocity profiles along a wall of a runner or close to runner entrance obstructions. In sum, runner entrance geometry is preferably adjusted to eliminate as much as possible high velocity mixture at a wall or against a wall's leading edge.

It has been found in an effort to make the intra-runner wall lengths as nearly equal as possible that the provision of a step in the common wall between the outside and inside runners of a runner pair with the step being presented to mixture in the outside runner that the wall lengths for the outside runners are made sensibly equal. With reference to FIG. 1, steps 108 and 110 for outside runners 28 and 36 are shown disposed inwardly of the leading edges of walls 56 and 60, walls 56 and 60 also defining one side of inside runners 26 and 36, respectively.

It will be noted that the floor of each of the runners extends further into the plenum than the roof of the runner. This again is for providing sensibly equal wall lengths. With reference to FIGS. 2 and 3, the reason for this extension is seen. Runners 36 and 38 turn down to meet and exit through sides 50 and 52, respectively, to meet the inlet ports. The angle of the sides requires extension of the floor into the plenum.

The entrance flow cross section into each runner is laid over from the upright, as viewed looking directly into the entrance of the runner from the plenum. For runner entrances 92 and 100 the layover is counterclockwise as viewed from the plenum, that is, the side walls of each runner lean from the runner floor to the left. The opposite holds true for runners 30 and 32. Here the side walls of the runners lean to the right. The side walls of runners 34 and 36, diametrically opposite runners 28 and 26 as viewed from inside the plenum, again lean to the left, and runners 38 and 40, diametrically opposite runners 32 and 30, viewed from the same position, lean to the right. The laid over entrances result in more nearly equal wall lengths, more nearly uniform flow velocity and pressure characteristics through the runners, and line-of-sight communication between the plenum and the inlet ports of an engine. The runner layover continues along the runner lengths until the runners approach their outlets where the side walls of the runners fall in vertical planes. One way of viewing the layover orientation is that in any flow cross section in the laid over portion of a runner, the roof of the runner is further from the longitudinal centerline of the manifold than the floor of the runner.

Continuing with the description of the entrances to the runners, the inner walls of the runners on each side of the longitudinal centerline of the manifold meet. The meeting defines a line disposed at an angle to the vertical, leaning laterally from floor to roof away from the longitudinal centerline of the manifold. For inner walls 112 and 114 of inside runners 26 and 40 there is a meeting at 116. Similarly, for inside runners 32 and 34, their inner walls 118 and 120 meet at 122.

It is evident that diametrically opposed runner pairs present to each other crossed entrances. This is readily seen by looking from within one runner pair to the diametrically opposite pair. The result of this is a barrier against reversion flow from one runner pair effecting the diametrically opposite pair.

The geometry of the flow passages in the runners is most clearly presented in FIGS. 5, 6 and 7, and FIGS. 9, 10 and 11. These figures are of sand cores used in casting the manifold to define the flow passages of the runners and the interior bounding walls of the plenum. They are drawn to scale. FIGS. 7 and 11 show runner cross-sectional configurations taken in the planes corresponding to the indicated dimensions, which are in inches. As can be seen for the short runners or legs of FIG. 5, the cores define essentially line-of-sight communication from the inside of the plenum through the exit from the runners. Similarly, with reference to FIG. 9, it is clear that essentially line-of-sight communication throughout the length of the long runner or legs is also effected.

More specifically, in FIG. 5 a sand core 130 has two legs 132 and 134 to define the flow passages in runners 26 and 40, respectively, and 34 and 32, respectively. In FIG. 6 leg 134 is shown. FIG. 7 shows the flow cross sections along the lengths of the runners (legs) in parallel planes which are perpendicular to the plane of the drawing and parallel to the longitudinal centerline of the manifold. The solid portion of the core between legs defines a portion of the plenum. Similarly, for FIGS. 9, 10 and 11, a sand core 136 has two legs 138 and 140 which define the flow passages of outside runners 38 and 28, respectively, and 30 and 36, respectively. FIG. 10 is a side elevation of leg 138. The solid portion between legs defines a portion of the plenum. The flow cross section of the runners (legs) shown in FIG. 10 are in parallel planes vertical to the plane of FIGS. 9 and 10 and parallel to the longitudinal centerline of the manifold.

When two sets of cores 130 and 136 are assembled, the plenum and flow passages of the runners are completely defined.

The present invention has been described with reference to a certain preferred embodiment. The spirit and scope of the appended claims should not, however, necessarily be limited to the foregoing description.

What is claimed is:

1. An improvement in an independent runner manifold for a carbureted internal combustion V-8 engine, the improved manifold comprising:

a. a plenum body defining a plenum chamber with a generally rectangular entrance, the plenum chamber being oriented at an acute angle to a bisecting vertical plane through the longitudinal centerline of the manifold and with the sides of the entrance at an acute angle to the bisecting vertical plane;

b. a runner for each cylinder of the engine having a flow passage beginning at the plenum chamber, an exit disposed for communication with an associated inlet port of the engine, and line-of-sight communication between the plenum chamber and the exit;

c. the entrances to the runners being disposed such that pairs of entrances share a single throat of a four-barrel carburetor mounted on the plenum body in register with the plenum chamber entrance and each runner sees a complete carburetor throat unobstructed by other manifold structure;

d. the runners being in runner pairs with each pair of runners having, relative to an imaginary line at right angles to the longitudinal centerline of the manifold and through the center of the plenum, an inner and an outer runner sharing a common wall; and e. the outer of each runner in each runner pair having a generally vertical step in the shared wall inwardly of the beginning of the shared wall at the plenum chamber to sensibly equalize the wall lengths within each outer runner.

2. The improvement claimed in claim 1 wherein:

a. the cross section of each runner is quadrilateral and each runner has four bounding walls; and b. the lengths of the walls of each runner are at least about equal.

3. The improvement claimed in claim 1 wherein the plenum chamber is above the exits of the runners.

4. The improvement claimed in claim 3 wherein each runner is laid over from the entrance thereof along a length thereof with the roof of the runner farther from the longitudinal bisecting plane than the floor in any flow cross section in the laid over portion of the runner.

5. The improvement claimed in claim 4 wherein the walls of each runner include an outer wall relative to the imaginary line, and each runner provides a sudden enlargement in the flow path it defines in the vicinity of its exit into the inlet port of the engine and along the outer wall of the runner.

6. An improvement in a manifold for use in a carbureted internal combustion engine, the improved manifold comprising:

a. a base;

b. a plenum body above the base defining a plenum chamber with a generally rectangular entrance, the plenum chamber being oriented at an acute angle to a bisecting plane through the longitudinal centerline of the manifold and with the sides of the entrance at an acute angle to the bisecting vertical plane; and c. independent runners leading from the plenum chamber to exits from the runners in the base disposed for communicating the runners with the inlet ports of the engine, each runner having a quadrilateral flow cross section, and each runner being laid over from its entrance and along a length thereof with the roof of the runner further from the bisecting plane than the floor in any flow cross section in the laid over portion of the runner.

7. The improved manifold claimed in claim 6 wherein: the entrances to the runner being disposed such that pairs of entrances share a single throat of a four-barrel carburetor mounted on the plenum body in register with the plenum entrance and each runner sees a complete carburetor throat unobstructed by other manifold structure.

8. The improved manifold claimed in claim 6 wherein the wall lengths of each runner are at least about equal.

9. The improved manifold claimed in claim 8 wherein:

a. the runners are oriented in runner pairs, with each runner pair sharing a common wall, each runner pair having an inner and an outer runner relative to an imaginary line at right angles to the bisecting plane and through the middle of the plenum chamber; and b. the outer of each runner pair having a step inwardly of the beginning of the common wall at the plenum chamber to sensibly equalize the wall lengths within the outer runner.

10. The improved manifold claimed in claim 9 wherein each runner defines line-of-sight communication between the plenum chamber and the exit from the runner.

11. The manifold claimed in claim 9 wherein the walls of each runner include an outer wall relative to the imaginary line, and each runner provides a sudden enlargement in the flow path it defines in the vicinity of its exit and along the outer wall thereof.

12. The improved manifold claimed in claim 10 wherein the flow cross-sectional area of each of the runners progressively diminishes in the direction of the runner's exit.

13. The improved manifold claimed in claim 12 wherein the enlargement of each runner is defined at the runner's exit by the outer wall of the runner presenting, when installed on an internal combustion engine, a step at the interface between the runner and its associated inlet port.

14. The improved manifold claimed in claim 13 in combination with an internal combustion engine.

* * * * *

UNITED STATES PATENT AND TRADEMARK OFFICE

CERTIFICATE OF CORRECTION

PATENT NO. : 3,931,811

DATED : January 13, 1976

INVENTOR(S) : James D. McFarland, Jr.

It is certified that error appears in the above-identified patent and that said Letters Patent are hereby corrected as shown below:

Column 3, line 20, "to" should be --at--.

Column 5, line 11, "same" should be --sand--.

Claim 11, column 10, line 48 "9" should be --10--.

Signed and Sealed this

*twentieth* Day of *April 1976*

[SEAL]

*Attest:*

RUTH C. MASON
*Attesting Officer*

C. MARSHALL DANN
*Commissioner of Patents and Trademarks*